United States Patent [19]

Zielinski et al.

[11] Patent Number: 4,604,941

[45] Date of Patent: Aug. 12, 1986

[54] EMERGENCY CHAMBERING DEVICE

[75] Inventors: Erich Zielinski, Haan; Harry Meschke, Düsseldorf, both of Fed. Rep. of Germany

[73] Assignee: Rheinmetall GmbH, Düsseldorf, Fed. Rep. of Germany

[21] Appl. No.: 671,047

[22] Filed: Nov. 13, 1984

Related U.S. Application Data

[63] Continuation of Ser. No. 421,095, Sep. 22, 1982, abandoned.

[30] Foreign Application Priority Data

Sep. 23, 1981 [DE] Fed. Rep. of Germany ..... 3137850

[51] Int. Cl.[4] ..... F41F 17/16

[52] U.S. Cl. ..... 89/47

[58] Field of Search ..... 89/45, 47, 36 K, 36 L, 89/37.02

[56] References Cited

U.S. PATENT DOCUMENTS

| | | | |
|---|---|---|---|
| 311,974 | 2/1885 | Gatling | 89/47 X |
| 1,656,727 | 1/1928 | Dawson et al. | 89/47 |
| 2,384,887 | 9/1945 | Brunner et al. | 89/37.02 |
| 2,849,924 | 9/1958 | Nutting et al. | 89/47 X |
| 2,933,982 | 4/1960 | Aldrin | 89/47 |
| 3,501,996 | 3/1970 | Lipp et al. | 89/36 K |
| 3,884,119 | 5/1975 | Zouck | 89/45 |
| 3,938,421 | 2/1976 | Nordmann | 89/47 |

FOREIGN PATENT DOCUMENTS

| | | |
|---|---|---|
| 2433568 | 1/1976 | Fed. Rep. of Germany . |
| 828183 | 5/1938 | France . |

*Primary Examiner*—Deborah L. Kyle
*Assistant Examiner*—John S. Maples
*Attorney, Agent, or Firm*—Spencer & Frank

[57] ABSTRACT

Manually actuable emergency chambering device for a system including a gun having a barrel provided with a loading end defining a loading chamber and disposed in a closed operator housing, and a loading tray disposed adjacent the loading end of the barrel, the barrel being pivotable about a horizontal trunnion axis. The device includes an elongate element and a rod assembly having a first end mounted for deflection movement relative to a first articulation region fixed relative to the trunnion axis and a second end spaced from the first end and connected to the rear end of the element to permit articulation movement between the element and the rod assembly at a second articulation region, the regions presenting articulation axes parallel to the trunnion axis and the rod assembly being deflectable along a path parallel to a vertical plane containing the barrel bore axis. The rod assembly is deflectable at the first region from a rest position toward an operating position so that the second end of the rod assembly moves toward the trunnion axis, while the front end of the element is in contact with the rear surface of the projectile, for causing the projectile to be pushed by the front end of the element off of the loading tray and then through the loading chamber into a chambered position corresponding to the operating position of the rod assembly.

16 Claims, 3 Drawing Figures

EMERGENCY CHAMBERING DEVICE

This application is a continuation of application Ser. No. 421,095, filed Sept. 22, 1982, now abandoned.

BACKGROUND OF THE INVENTION

The present invention relates to an emergency chambering device for a gun of the type mounted in a tank turret.

In guns of the type under consideration there are provided, for example, electrohydraulic chambering devices. Particularly for the purpose of realizing a rapid firing sequence, such devices are absolutely necessary in corresponding systems. Although this is also the case with field mounted guns and a chambering device for such weapons is disclosed, for example, in U.S. Pat. No. 3,938,421, the crowded conditions in the interior of a tank turret create a need for such device also in guns of the above-mentioned type.

A malfunction of the system integrated chambering device necessitates manual chambering. This is usually done by means of a rod having a sufficient length and bending resistance. Such manual chambering has been found to be very cumbersome even in the lower angle group. As a result, the firing sequence is much slower than under normal conditions, which is a drawback.

SUMMARY OF THE INVENTION

It is an object of the present invention to provide an emergency chambering device of the above-mentioned type which facilitates manual chambering and substantially simplifies the process.

The above and other objects are achieved, according to the invention, by the provision of a novel manually actuable emergency chambering device for a system including a gun having a barrel provided with a loading end defining a loading chamber and disposed in a closed operator housing, and a loading tray disposed adjacent the loading end of the barrel, the barrel being pivotable about a horizontal trunnion axis, the device including:

an elongate element having a front end and a rear end; and a rod assembly having a first end mounted for deflection movement relative to a first articulation region fixed relative to the trunnion axis and a second end spaced from the first end and connected to the rear end of the element to permit articulation movement between the element and the rod assembly at a second articulation region associated with the second end of the rod assembly, the first and second regions both presenting articulation axes parallel to the trunnion axis and the rod assembly being deflectable between a rest position and an operating position along a path lying in a plane parallel to a plane containing the barrel bore axis, the element being deflectable at the second region for bringing the front end into a first position in which the front end rests against the rear surface of a projectile supported on the loading tray while the rod assembly is in the rest position; and the rod assembly being deflectable at the first region from the rest position toward the operating position so that the second end of the rod assembly moves toward the trunnion axis, while the front end of the element remains in contact with the rear surface of the projectile, for causing the projectile to be pushed by the front end of the element off of the loading tray and then through the loading chamber into a chambered position corresponding to the operating position of the rod assembly.

The invention will be described in greater detail below with reference to a preferred embodiment illustrated in the Figures of the drawing in a substantially schematic manner with details not significant to the invention being omitted.

DESCRIPTION OF THE PREFERRED EMBODIMENTS

Figure 1:
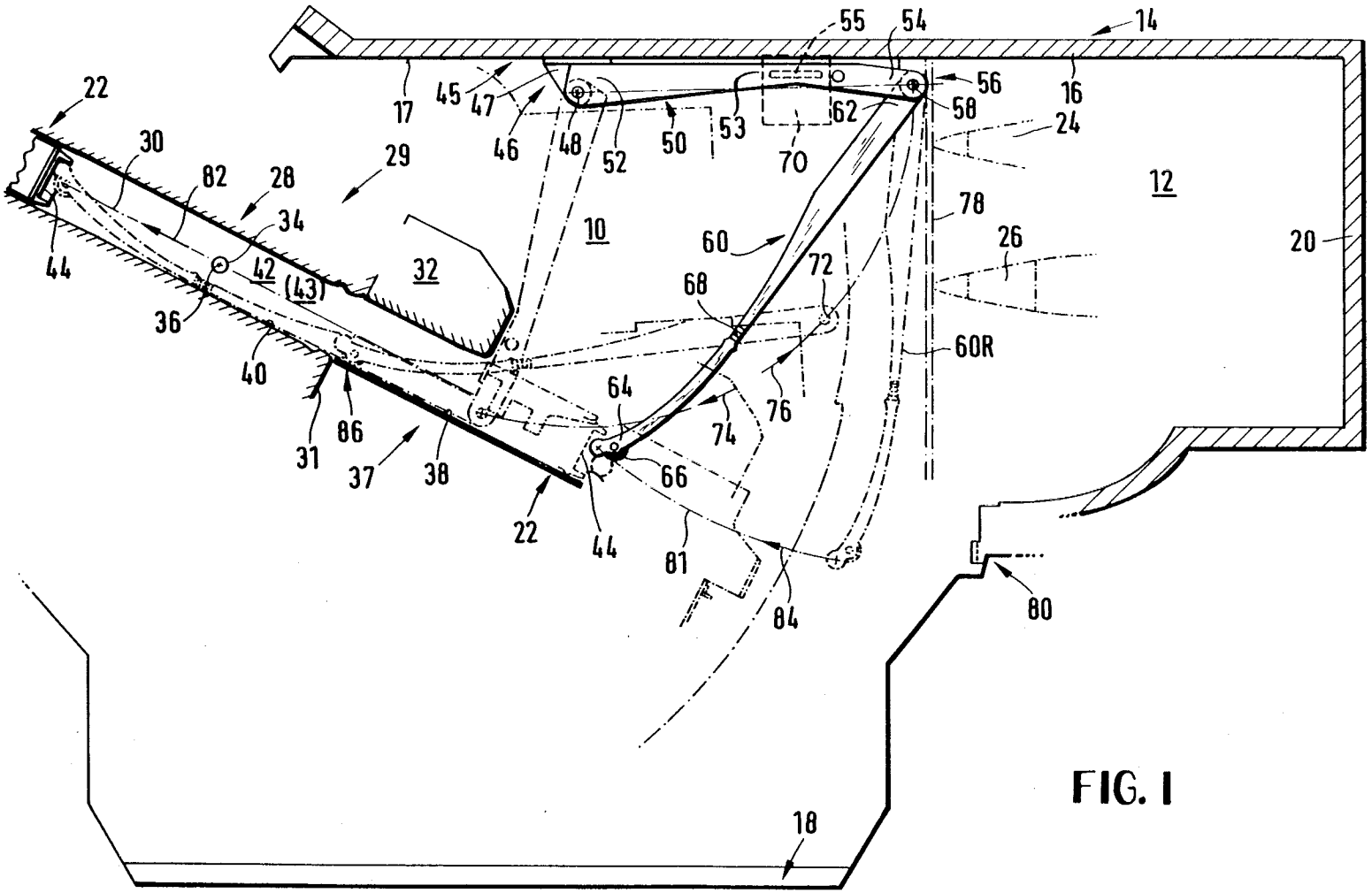
FIG. 1 is a cross-sectional view of a tank turret and the breech side portion of a gun equipped with the preferred embodiment of a device according to the invention.

The Figure shows a tank turret 14 which encloses a compartment 10 for a gun crew and an interior space 12 adjacent thereto and located toward the rear for an ammunition magazine (not shown). The tank turret 14 has a cover 16 presenting a lower surface 17, a bottom 18, a rear wall 20 and a ring gear 80 for mounting the turret on an armored vehicle (not shown). A gun 29 is mounted in the turret and includes a barrel 28 extending along a bore axis 30. Gun 29 is not shown in detail.

In the illustrated state, an open breech 32 is positioned immediately adjacent the top region of the rear edge 31 of the bore in barrel 28, and a charger, or loading tray, 37 is disposed immediately adjacent the underside of the edge 31 of the barrel 28. Only the region of the support surface 38 of the tray 37 is shown.

The gun 29 is mounted to be adjustable in elevation by being pivoted about a trunnion 34 having a pivot axis 36. The loading tray surface 38 is flush with the lower region of an inner face 40 of the barrel bore defining the circumference of a loading chamber 43.

At the underside 17 of the cover 16, at a point 45 which is fixed with respect to the trunnion pivot axis 36, there is disposed an articulating block 47. There is thus defined a first articulation region 46 with an associated pivot axis 48. A one-piece, preferably trough-shaped, rod assembly 50 has a front end 52 mounted to pivot about the pivot axis 48. The rear end 54 of the rod assembly 50 defines a second articulation region 56 with a pivot axis 58.

Figure 3:
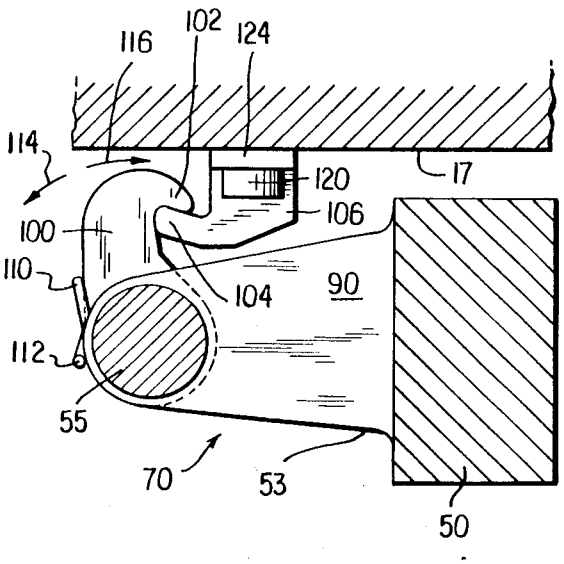
FIG. 3 is a cross-sectional view along line III—III of the device shown in FIG. 2.
Figure 2:
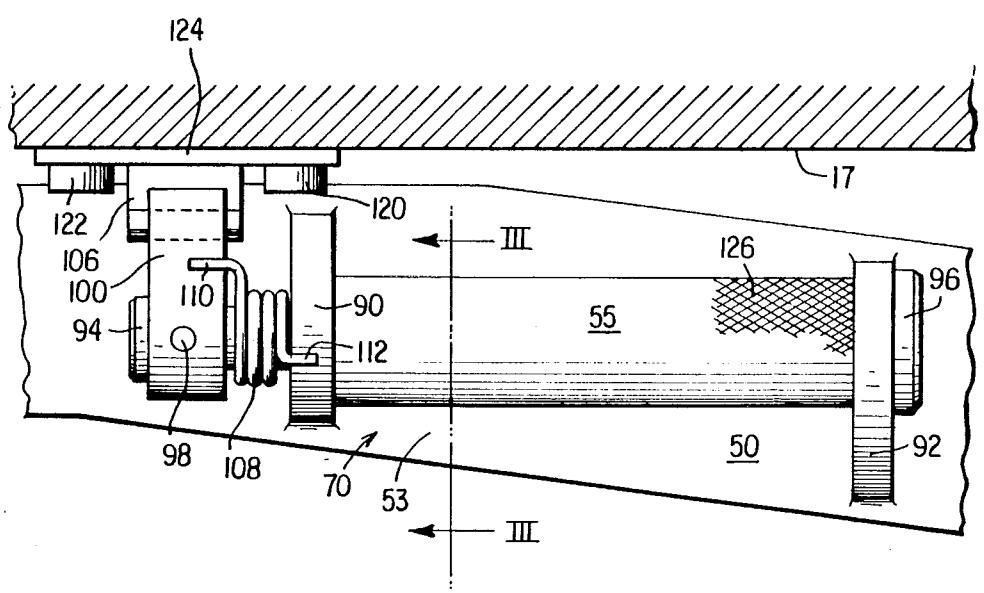
FIG. 2 is an enlarged scale side-elevational view of an auxiliary device shown in dashed lines in FIG. 1.

The rear end 62 of a rod element 60 is articulated to the pivot axis 58 while the free front end 64 of element 60 is provided with a roller 66. In a region not specifically designated, element 60 is provided with a handle 68. The rod assembly 50 is fixed, in its rest position shown in solid lines, to the underside 17 of the cover 16 but can be released by means of an auxiliary device 70 arranged in a region shown in dashed lines. The auxiliary device 70 (FIG. 2 and FIG. 3) includes a handle 55. It is shaped as a cylindrical rod with one end 94 having a reduced diameter and the other end 96 having a larger diameter. The handle 55 is mounted for rotation by supports 90 and 92 which are disposed on rod assembly 50 in the region 53. A hook 100 is fixed by a bolt 98 to end 94. A coil-shaped spring 108 surrounds part of handle 55 and has ends 110 and 112, the end 110 engaging hook 100 and the end 112 engaging support 90. Spring 108 biases handle 55 and hook 100 in the direction of arrow 116 to restore them after handle 55 has been rotated in the direction of arrow 114. A support 106 includes a plate 124 and a nose 104 for releasable engagement with nose 102 of hook 100. Plate 124 is fixed to the lower surface 17 of cover 16 by screws 120 and 122. The surface 126 of handle 55 is shown as being grooved for better traction when handle 55 is manually gripped.

To release rod assembly 50 during operation, handle 55 is manually rotated in the direction of arrow 114, thereby disengaging nose 102 from nose 104.

After operation noses 102 and 104 are re-engaged to secure rod assembly 50 in its rest position.

Trunnion 34, rod assembly 50, and rod element 60 shown in FIG. 1 are arranged (e.g. inside a tank turret) in such as way that their respective axes 36, 48, and 58 always remain in mutually parallel relationship, so that an imaginary plane which is defined by arcs 72 and 81 (which are described in more detail below) includes the bore axis 30 of the barrel 28.

In its rest position, the element 60 takes on the position 60R shown in broken lines. In this position element 60 is adjacent a region 78 coinciding with the tips of projectiles 24 and 26 disposed in a magazine and shown only schematically.

The actuation of the emergency chambering device is effected as follows:

First, the element 60 is moved by one of the operator's hands on handle 68, so that its free front end 64 moves along an arc 81 about the pivot axis 58 of the second articulation region 56 in the direction of the arrow 84 against the bottom 44 of a projectile 22 shown in broken lines as resting on loading tray 37.

Then the operator's other hand moves, by engaging a handle 55 disposed in the region 53 of rod assembly 50, the latter rod assembly first out of its rest position, in which it is normally held by means of device 70, the movement being such that the second pivot axis 58 approaches the trunnion axis 36 in the direction of arrow 74 on an arc 72. This begins to advance the projectile 22 out of the loading tray 37.

Upon further pivoting of assembly 50, the roller 66, while rolling on surface 38, reaches an area 86, and then rolls upon the inner face 40 of the barrel, while the projectile 22 is advanced in the direction of arrow 82 through the loading chamber 42 until it reaches the chambered position. The chambered position is indicated by the solid-line position of the bottom 44 of projectile 22.

Then, element 60 is withdrawn from the loading chamber 42 in the direction opposite to arrow 82 to permit introduction of a propellant charge (not shown) into the loading chamber 42 in a conventional manner that will not be described in detail. The assembly rod 50 is then moved by means of the pivot axis 48 along arc 72 in the direction of the arrow 76 and is then fixed again by means of device 70 in its releasable rest position under cover 16.

The emergency chambering device according to the invention is distinguished advantageously by its simplicity and can be used within a barrel elevation range of between about 25° and about 45° in order to facilitate manual chambering.

It will be understood that the above description of the present invention is susceptible to various modifications, changes and adaptations, and the same are intended to be comprehended within the meaning and range of equivalents of the appended claims.

What is claimed is:

1. Manually actuable emergency chambering device for a system including a gun disposed in a closed operator housing and having a large caliber barrel provided with a loading end defining a loading chamber near the far end of which a shell is to be rammed, a loading tray disposed adjacent the loading end of the barrel, and means for pivotably mounting the barrel about a horizontal trunnion axis but permitting the barrel to move linearly with respect thereto when the gun is fired, said device comprising:

a selectively manually deflectable rod assembly having a first end mounted for deflection movement relative to a first articulation region fixed relative to the trunnion axis and a second end spaced from said first end, said first articulation region presenting an articulation axis parallel to the trunnion axis and said rod assembly being deflectable at said first articulation region, between a rest position and an operating position, along a path lying in a plane that is parallel to the barrel bore axis;

selectively manually deflectable elongated element means, having a front end and a rear end connected to said second end of said rod assembly to permit articulation movement between said elongated element means and said rod assembly at a second articulation region which is associated with said second end of said rod assembly and which presents an articulation axis parallel to the trunnion axis, for bringing said front end into a first position, in which said front end rests against the rear surface of a shell supported on the loading tray while said rod assembly is in said rest position, when said elongated element means is deflected at said second articulation region, and, while said front end of said elongated element means remains in contact with the rear surface of the shell, for pushing the shell off of the loading tray and then through the loading chamber into a rammed position corresponding to the operating position of said rod assembly when said rod assembly is deflected at said first articulation region from said rest position toward said operating position so that the second end of the rod assembly moves toward the trunnion axis; and a roller rotatably mounted at said front end of said elongated element means for reducing friction between said front end and the surface of the loading tray and with the interior of the barrel.

2. Emergency chambering device as defined in claim 1 wherein the operator housing includes a cover carrying said first articulation region.

3. Emergency chambering device as defined in claim 1, wherein the shell has an axis, wherein said loading tray has an axis that is parallel to the axis of said barrel, and wherein said selectively manually deflectable elongated element means pushes the shell from the loading tray and into said rammed position by moving the shell along its axis.

4. Emergency chambering device as defined in claim 1 wherein each said articulation region has an associated pivot axis and said rod assembly is made of one piece.

5. Emergency chambering device as defined in claim 4 wherein the operator housing includes a cover carrying said first articulation region.

6. Emergency chambering device as defined in claim 4 further comprising a member for releasably fixing said rod assembly in said rest position.

7. Emergency chambering device as defined in claim 1 further comprising a member for releasably fixing said rod assembly in said rest position.

8. Emergency chambering device as defined in claim 7 wherein the operator housing includes a cover carrying said first articulation region.

9. A manually actuable emergency chambering device for use in a tank which includes a turret, a large caliber gun barrel having a bore with an axis and having a loading end which is disposed within the turret, means for pivotably mounting the barrel about a horizontal trunnion axis but permitting the barrel to move linearly along the bore axis when the gun is fired, and a loading tray adjacent the loading end of the barrel to support a shell having an axis so that the shell axis lies along the axis of the bore, comprising:

an elongated rod assembly having a first end and a second end;

means mounting said first end of said rod assembly to said turret for rotating said rod assembly about a first axis that is parallel to the trunnion axis and a fixed distance from the trunnion axis;

an elongated element having a first end and a second end;

means mounting said first end of said elongated element to said second end of said rod assembly for rotating said elongated element with respect to said rod assembly about a second axis that is parallel to the trunnion axis and a fixed distance from said first axis; and means for releasably securing said rod assembly to said turret while said elongated element is manually rotated about said second axis to bring said second end of said elongated element into contact with a shell supported on said loading tray, said rod assembly thereafter being released from said turret and manually rotated about said first axis so that said elongated element pushes the shell along its axis into the loading end of the barrel, said second end of said elongated element entering the loading end of the barrel.

10. The device of claim 9, further comprising a roller mounted at said second end of said elongated element.

11. The device of claim 9, wherein said means for releasably securing comprises a hook rotatably mounted on said rod assembly, a plate element fixedly mounted on said turret, and spring means for biassing said hook in a position wherein said hook engages said plate to releaseably secure said rod assembly.

12. The device of claim 11, wherein said means for releasing securing further comprises a manually operable handle rotatably mounted on said rod assembly and operatively connected to said hook.

13. Manually actuable emergency chambering device for a system including a gun disposed in a closed operator housing and having a large caliber barrel provided with a loading end defining a loading chamber near the far end of which a shell is to be rammed, a loading tray disposed adjacent the loading end of the barrel, and means for pivotably mounting the barrel about a horizontal trunnion axis but permitting the barrel to move linearly with respect thereto when the gun is fired, said device comprising:

a selectively manually deflectable rod assembly having a first end mounted for deflection movement relative to a first articulation region fixed relative to the trunnion axis and a second end spaced from said first end, said rod assembly being made of one piece, said first articulation region presenting an associated pivot axis parallel to the trunnion axis and said rod assembly being deflectable at said first articulation region, between a rest position and an operating position, along a path lying in a plane that is parallel to the barrel bore axis;

selectively manually deflectable elongated element means, having a front end and a rear end connected to said second end of said rod assembly to permit articulation movement between said elongated element means and said rod assembly at a second articulation region which is associated with said second end of said rod assembly and which presents an associated pivot axis parallel to the trunnion axis, for bringing said front end into a first position, in which said front end rests against the rear surface of a shell supported on the loading tray while said rod assembly is in said rest position, when said elongated element means is deflected at said second articulation region, and, while said front end of said elongated element means remains in contact with the rear surface of the shell, for pushing the shell off of the loading tray and then through the loading chamber into a rammed position corresponding to the operating position of said rod assembly when said rod assembly is deflected at said first articulation region from said rest position toward said operating position so that the second end of the rod assembly moves toward the trunnion axis; and a roller rotatably mounted at said front end of said elongated element means for reducing friction between said front end and the surface of the loading tray and with the interior of the barrel.

14. Emergency chambering device as defined in claim 13 wherein the operator housing includes a cover carrying said first articulation region.

15. Emergency chambering device as defined in claim 13 further comprising a member for releasably fixing said rod assembly in said rest position.

16. Emergency chambering device as defined in claim 15 wherein the operator housing includes a cover carrying said first articulation region.

* * * * *